US010405628B2

(12) United States Patent
Maldonado-Liddy

(10) Patent No.: US 10,405,628 B2
(45) Date of Patent: Sep. 10, 2019

(54) ACCESSORY STORAGE DEVICE

(71) Applicant: Johana Maldonado-Liddy, Media, PA (US)

(72) Inventor: Johana Maldonado-Liddy, Media, PA (US)

( * ) Notice: Subject to any disclaimer, the term of this patent is extended or adjusted under 35 U.S.C. 154(b) by 0 days.

(21) Appl. No.: 15/996,890

(22) Filed: Jun. 4, 2018

(65) Prior Publication Data

US 2018/0352932 A1 Dec. 13, 2018

Related U.S. Application Data

(60) Provisional application No. 62/518,219, filed on Jun. 12, 2017.

(51) Int. Cl.
*A45D 8/00* (2006.01)

(52) U.S. Cl.
CPC ..... *A45D 8/00* (2013.01); *A45D 2008/002* (2013.01)

(58) Field of Classification Search
CPC ..... A45D 8/00; A45D 2008/002; A45D 2008/004; A63H 3/50; A63H 33/006; F16M 13/022
See application file for complete search history.

(56) References Cited

U.S. PATENT DOCUMENTS 1,961,527 A * 6/1934 Petro ..... B42D 3/145 116/238
D138,777 S * 9/1944 Lewis ..... D21/594
D161,962 S * 2/1951 Plante ..... D21/594
2,645,197 A * 7/1953 Jones ..... B42D 3/145 116/238
2,664,847 A * 1/1954 Orman ..... B42D 9/002 116/239
3,143,998 A * 8/1964 Madden ..... B42D 3/145 116/238
3,856,140 A * 12/1974 Fitts ..... B65H 57/16 206/1.7
4,172,521 A * 10/1979 Eubanks ..... D05C 1/065 206/388
5,022,342 A * 6/1991 Davis ..... B42D 3/145 116/236
5,443,029 A * 8/1995 Garnet ..... B42D 9/002 116/235
5,626,503 A 5/1997 Heftel et al.
6,076,685 A * 6/2000 Ramirez ..... A47F 5/0006 211/113
6,305,386 B1 10/2001 Wochadlo
(Continued)

*Primary Examiner* — Ko H Chan
(74) *Attorney, Agent, or Firm* — Global Intellectual Property Agency, LLC; Daniel Boudwin

(57) ABSTRACT

A device for storing accessories, such as hair ties, barrettes, or other clips. The accessory storage device includes a flat plane, having a front side and a rear side, and one or more fasteners attached to the rear side. An upper portion of the flat plane is shaped to resemble a head and has a perimeter along which an elongated aperture is placed. A plurality of elongated strands extends from the elongated aperture. The elongated aperture is designed to receive the plurality of elongated strands through it and fasten to the perimeter of the elongated aperture, such that the plurality of elongated strands extends over the front side. The plurality of elongated strands is designed to attach with a clip or other type of accessory.

16 Claims, 10 Drawing Sheets

(56) References Cited

U.S. PATENT DOCUMENTS

| | | | | |
|---|---|---|---|---|
| 6,352,048 | B1 * | 3/2002 | Scott | B42D 9/004 116/237 |
| 6,422,914 | B1 * | 7/2002 | Nelson | A63H 27/10 248/346.03 |
| 6,533,634 | B1 * | 3/2003 | Sugar | A63H 3/50 119/707 |
| D519,155 | S * | 4/2006 | Scott | D19/34 |
| 7,226,290 | B2 * | 6/2007 | Nickol | G09F 5/02 206/388 |
| 8,973,291 | B2 * | 3/2015 | Mayer | B42D 15/022 40/124.03 |
| 9,072,350 | B2 | 7/2015 | Groth | |
| 9,441,785 | B2 * | 9/2016 | Sterling | F16M 13/022 |
| 2005/0130557 | A1 * | 6/2005 | Demetrius | A63H 3/02 446/369 |
| 2005/0258116 | A1 | 11/2005 | Mandelbaum et al. | |
| 2007/0048067 | A1 * | 3/2007 | Gerules | B43K 23/001 401/195 |
| 2012/0305509 | A1 * | 12/2012 | Benson | F16M 13/022 211/85.7 |
| 2013/0193097 | A1 | 8/2013 | Pritchett-Brown | |

* cited by examiner

ACCESSORY STORAGE DEVICE

CROSS REFERENCE TO RELATED APPLICATIONS

This application claims the benefit of U.S. Provisional Application No. 62/518,219 filed on Jun. 12, 2017. The above identified patent application is herein incorporated by reference in its entirety to provide continuity of disclosure.

BACKGROUND OF THE INVENTION

The present invention relates to storage devices for accessories. More specifically, the present invention provides a planar member having a front side and a rear side, wherein the rear side has one or more fasteners affixed thereto, and having an upper portion configured to resemble a head along which an elongated aperture is disposed, wherein a plurality of elongated strands extends therefrom, such that each strand is adapted to removably couple with an accessory, such as a hair barrette.

Many children enjoy dressing up using a variety of hair accessories, such as hair ties, scrunchies, barrettes or other clips. However, it is quite common for the children to misplace these hair accessories, resulting in frustration for parents when attempting to dress their child and the hair accessory desired cannot be found. Additionally, the loss of the hair accessories results in a monetary loss. If not stored properly, the hair accessories can also be stepped on and broken in addition to becoming lost. Although parents often purchase storage containers for their children to organize the hair accessories, the child frequently finds it boring to put away the hair accessories, and the storage container goes unused. Thus, an improved accessory storage device is desired to allow parents and children to easily and efficiently store a multitude of hair accessories.

SUMMARY OF THE INVENTION

In view of the foregoing disadvantages inherent in the known types of accessory storage devices now present in the known art, the present invention provides a new accessory storage device wherein the same can be utilized for providing convenience for the user when storing a plurality of accessories.

It is therefore an object of the present invention to provide a new and improved accessory storage device that has all the advantages of the known art and none of the disadvantages. The present system comprises a planar member, having a front side and a rear side, wherein the rear side has one or more fasteners affixed thereto. An upper portion of the planar member is configured to resemble a head and has a periphery along which an elongated aperture is disposed. The elongated aperture is configured to receive the plurality of elongated strands therethrough and thereby affix to a perimeter of the elongated aperture, such that each strand of the plurality of strands is tied to the perimeter of the elongated aperture. In this way, the plurality of elongated strands extends over the front side of the member. The plurality of elongated strands is configured to removably couple with a plurality of accessories, such as hair ties or barrettes.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
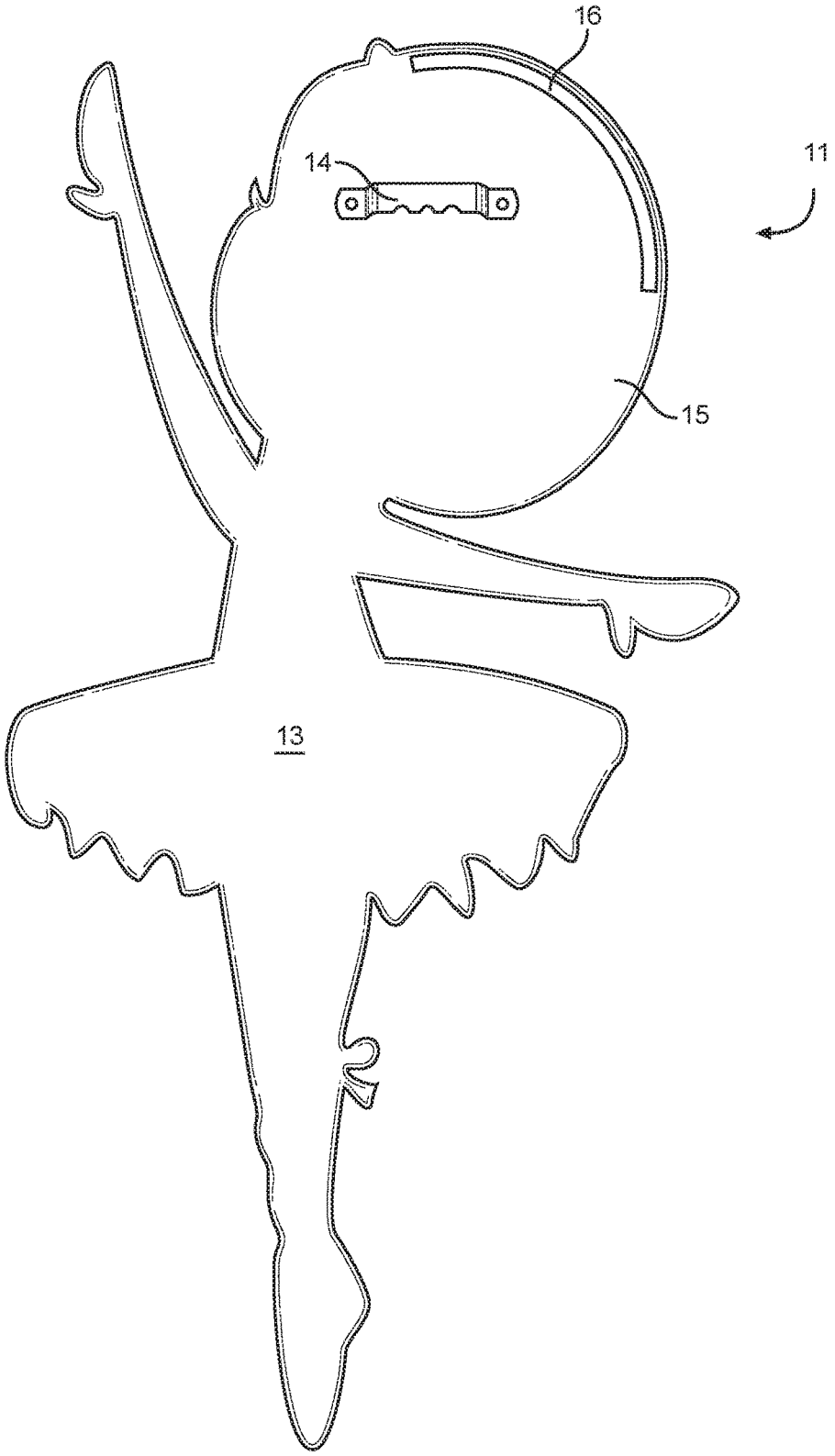
FIG. 1A shows a back facing view of an embodiment of the planar member of the accessory storage device.

Reference is made herein to the attached drawings. Like reference numerals are used throughout the drawings to depict like or similar elements of the accessory storage device. The figures are intended for representative purposes only and should not be considered to be limiting in any respect.

Figure 2:
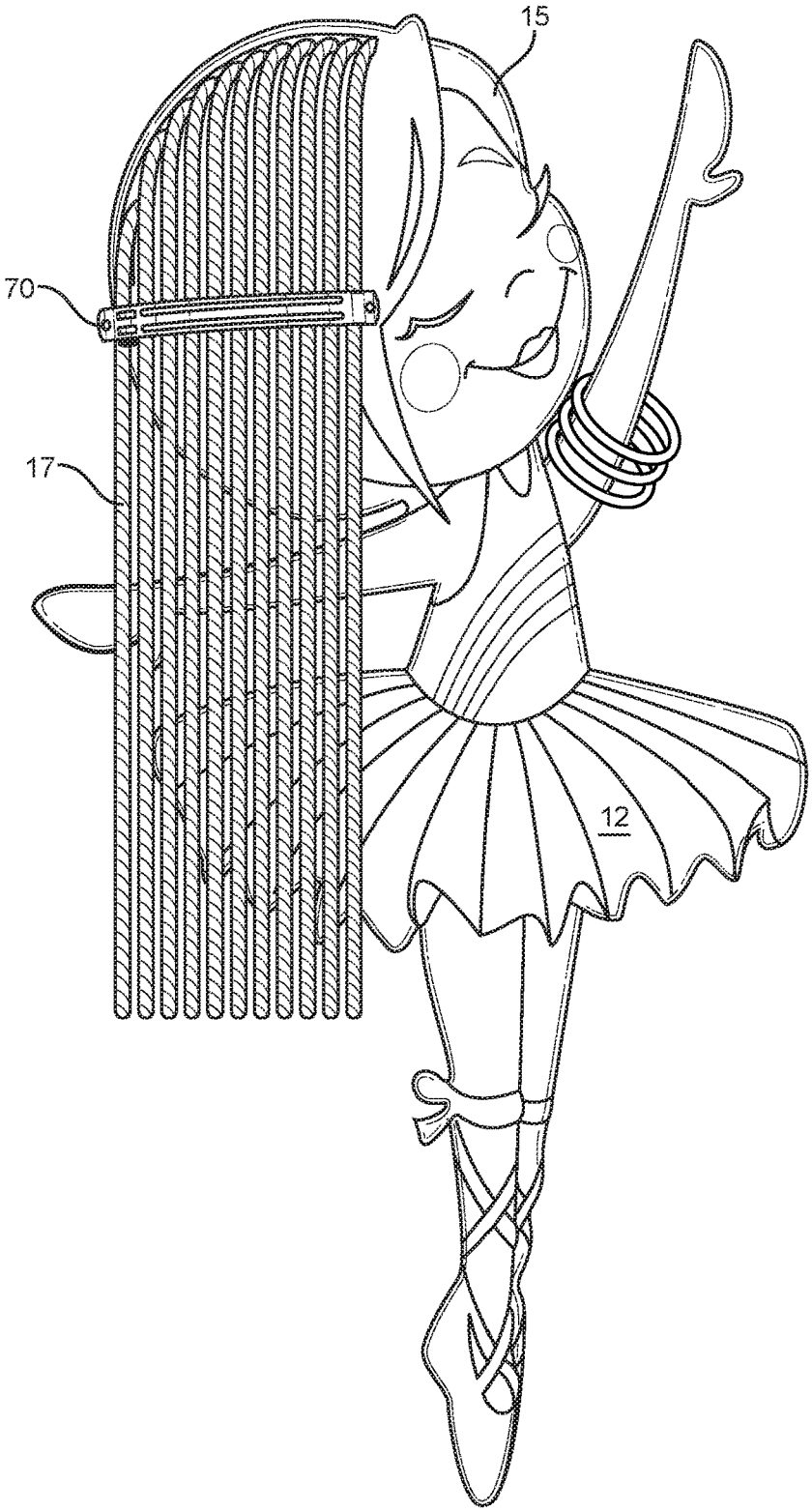
FIG. 2 shows a front facing view of an embodiment of the accessory storage device in use.

Referring now to FIG. 1A, there is shown a back facing view of an embodiment of the planar member of the accessory storage device. An accessory storage device comprises a planar member 11, having a front side 12 (as shown in FIG. 2) and a rear side 13, wherein the rear side 13 has one or more fasteners 14 affixed thereto. In the illustrated embodiment, the fastener 14 comprises a hook thereby allowing the planar member 11 to removably affix to a planar surface such as a wall or a door. In one embodiment of the accessory storage device, the planar member 11 is configured to have a length of at least 12 inches along a single axis between the distalmost ends. However, in other embodiments, the planar member 11 comprises a length less than 12 inches along a single axis. In the illustrated embodiment, the planar member 11 is configured to resemble a humanoid or anthropomorphized animal figure, such that a portion of the planar member 11 is configured to resemble a head 15. The head portion 15 has a periphery along which an elongated aperture 16 is disposed. In one embodiment, the head portion 15 of the planar member 11 is configured to have a diameter of at least 6 inches. In an additional embodiment, the elongated aperture 16 is configured such that the length of the elongated aperture 16 extends at least 25% about the circumference of the head portion.

Figure 1B:
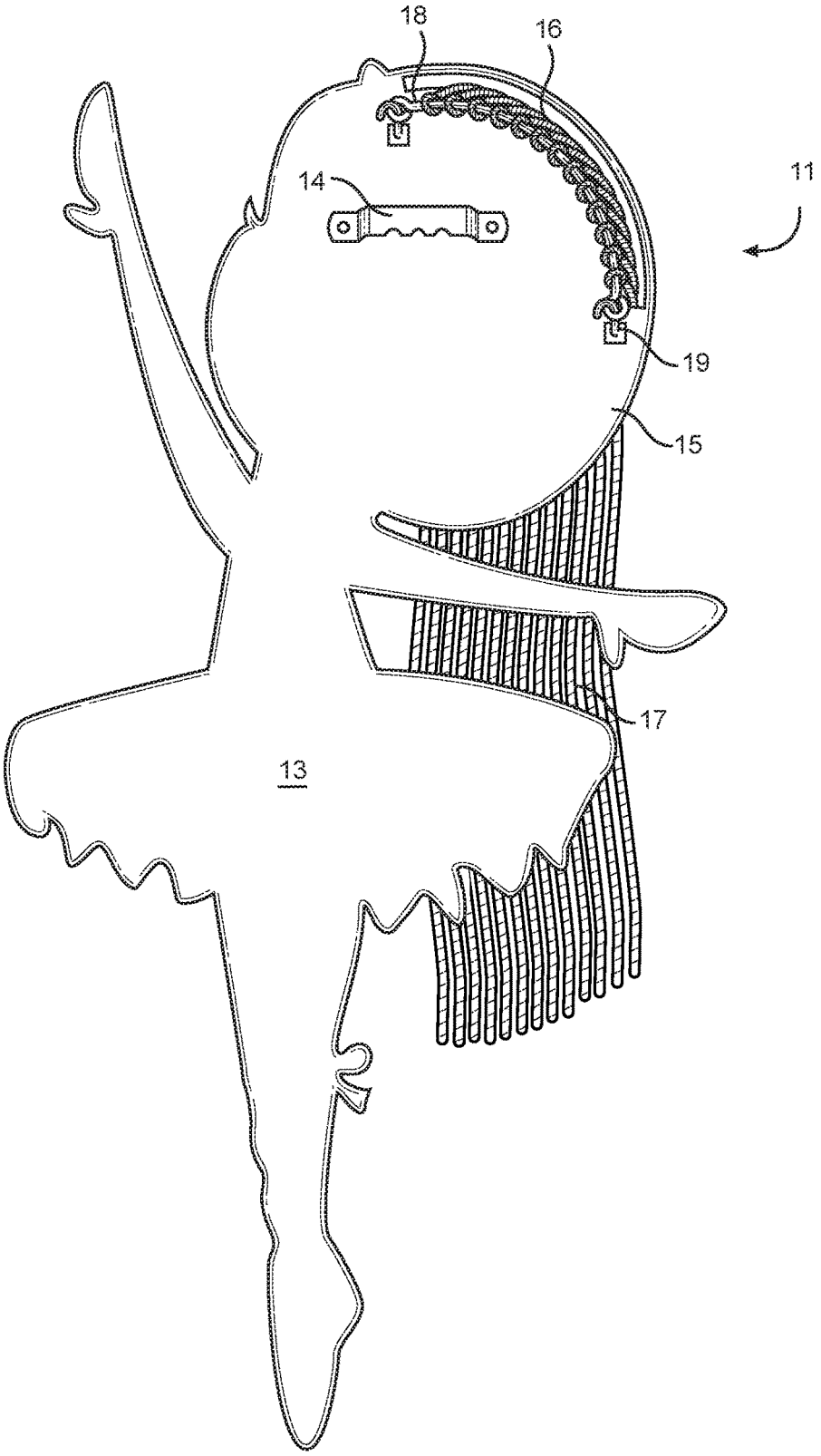
FIG. 1B shows a back facing view of an embodiment of the planar member of the accessory storage device with the elongated strands fastened to the rear side.

Referring now to FIG. 1B, there is shown a back facing view of an embodiment of the planar member of the accessory storage device with the elongated strands fastened to the rear side. In one embodiment, a plurality of elongated strands 17 are affixed to a rail 18, wherein the elongated aperture 16 is configured to receive the rail 18 therethrough. In the illustrated embodiment, the rail 18 is a metal rod, however in other embodiments, a flexible rod is used, and any suitably durable material, such as plastic, is used.

The rail 18 is configured to removably affix to the rear side 13 of the planar member 11 via a fastener 19. In this way, the plurality of elongated strands 17 is configured to be interchangeable with another plurality of elongated strands, such as those of another color. The fastener 19 is disposed on the rear side 13 proximal to the elongated aperture 16, such as within three inches of the elongated aperture 16. In the illustrated embodiment, the fastener 19 is a plurality of hooks wherein the rail 18 has a receiving plurality of loops to thereby removably fasten to the rear side 13 of the planar member 11. However, in other embodiments, the fastener 19 is a curved lip, composed of a suitably durable material such as wood or metal, affixed to the rear side 13, wherein an opening of the lip is disposed opposite to the aperture, such that the lip is configured to receive the full length of the rail 18. In other embodiments, any suitably durable fastener, such as a magnet, comprises the fastener 19. In an additional embodiment, the elongated aperture 16 has an opening on one end, such that the rail 18 slidably engages the elongated aperture 16, and removably affixes to the fastener 19.

Figure 1C:
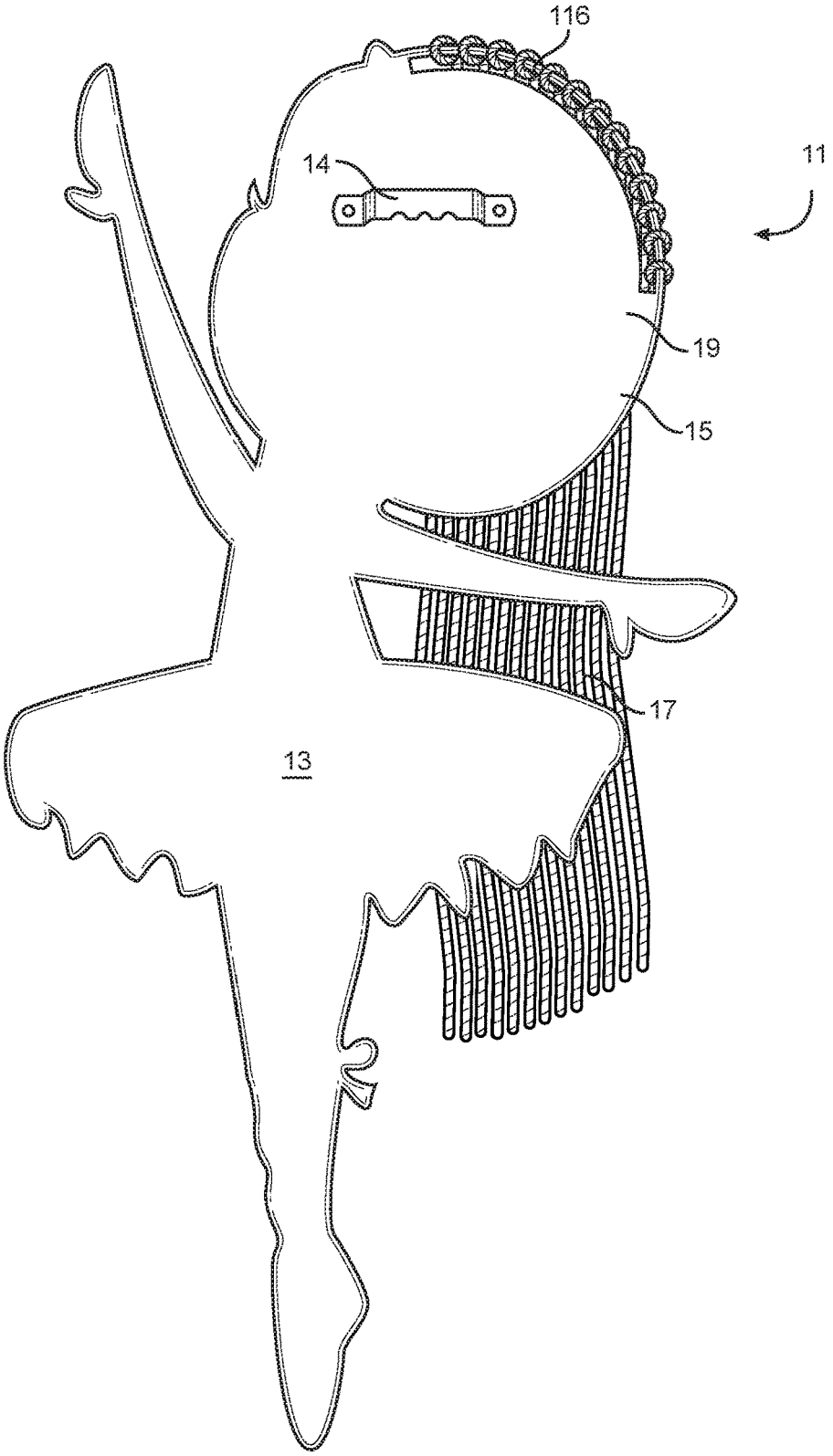
FIG. 1C shows a back facing view of an embodiment of the planar member of the accessory storage device with the elongated strands affixed to the perimeter of the elongated aperture.

Referring now to FIG. 1C, there is shown a back facing view of an embodiment of the planar member of the accessory storage device with the elongated strands affixed to the perimeter aperture. In one embodiment, the plurality of elongated strands 17 is directly affixed to an outer perimeter of the elongated aperture 116. In this way, the elongated aperture is configured to receive each elongated strand 17 of the plurality of strands, and each strand 17 is individually tied to the outer perimeter 116. In one embodiment, the elongated strands 17 are composed of yarn, however in other embodiments they are composed of any suitably durable material, such as string or acrylic. The elongated strands 17 are individually tied to the outer perimeter 116 in one embodiment using knots, such as a Lark's head knot. However, in other embodiments, the elongated strands 17 are affixed to the outer perimeter 116 via adhesive.

Referring now to FIG. 2, there is shown a front facing view of an embodiment of the accessory storage device in use. The accessory storage device is configured such that when the plurality of elongated strands 17 are affixed through the elongated aperture, the plurality of elongated strands 17 are configured to extend over the front side 12 (as shown in FIG. 1B and FIG. 1C). In one embodiment, the length of each elongated strand 17 measures at least 6 inches. In the shown embodiment, the elongated strands 17 are configured to couple with a hair accessory 70, such that a user, such as a child, can removably affix a plurality of hair accessories 70, such as hair barrettes, to the elongated strands 17. However, in other embodiments, other accessories, such as office accessories, are clipped to the plurality of elongated strands 17. In this way, a user can utilize the accessory storage device as an organizational tool for a plurality of different accessories.

Figure 3A:
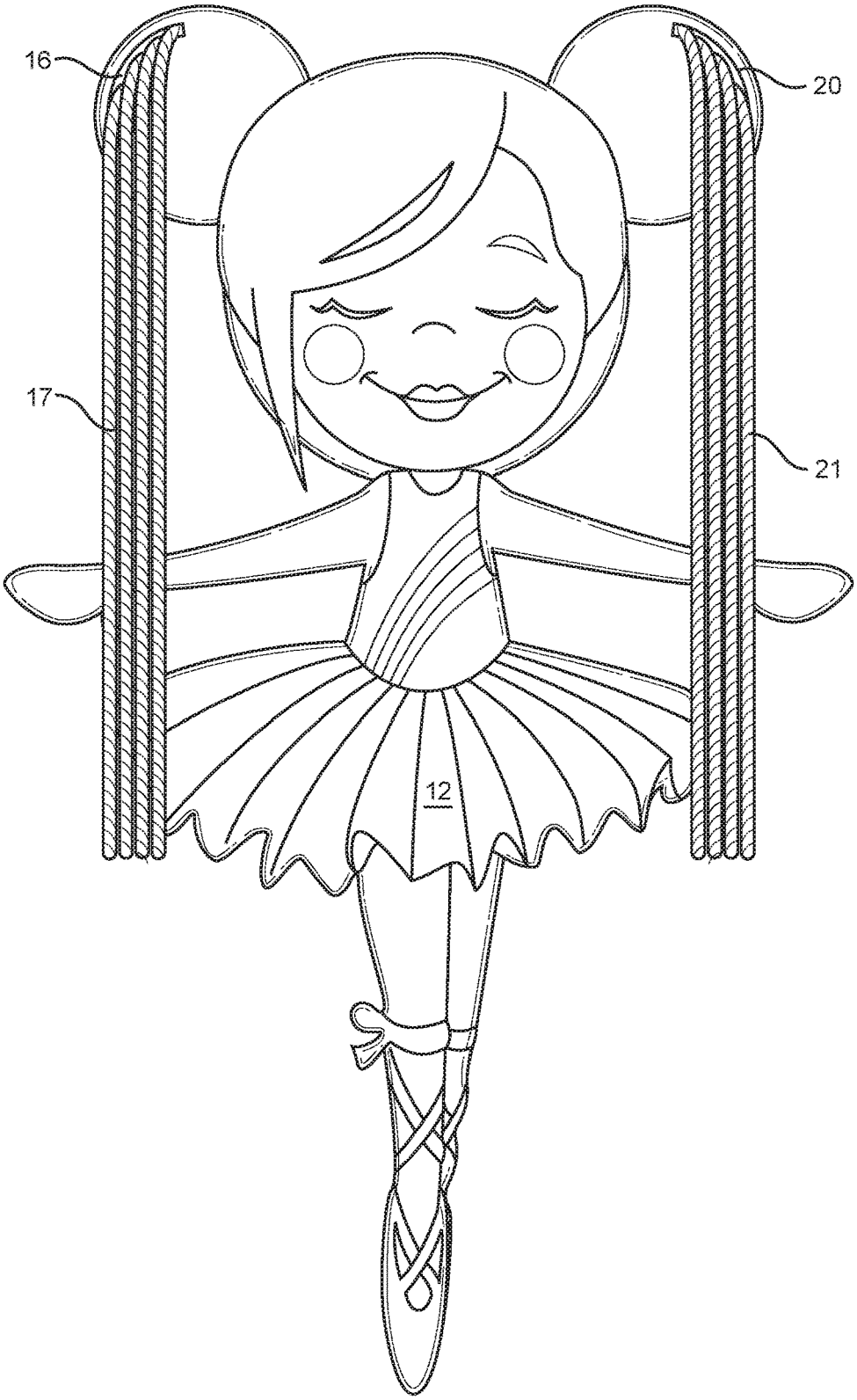
FIG. 3A shows a front facing view of an embodiment of the accessory storage device with an additional aperture.
Figure 3B:
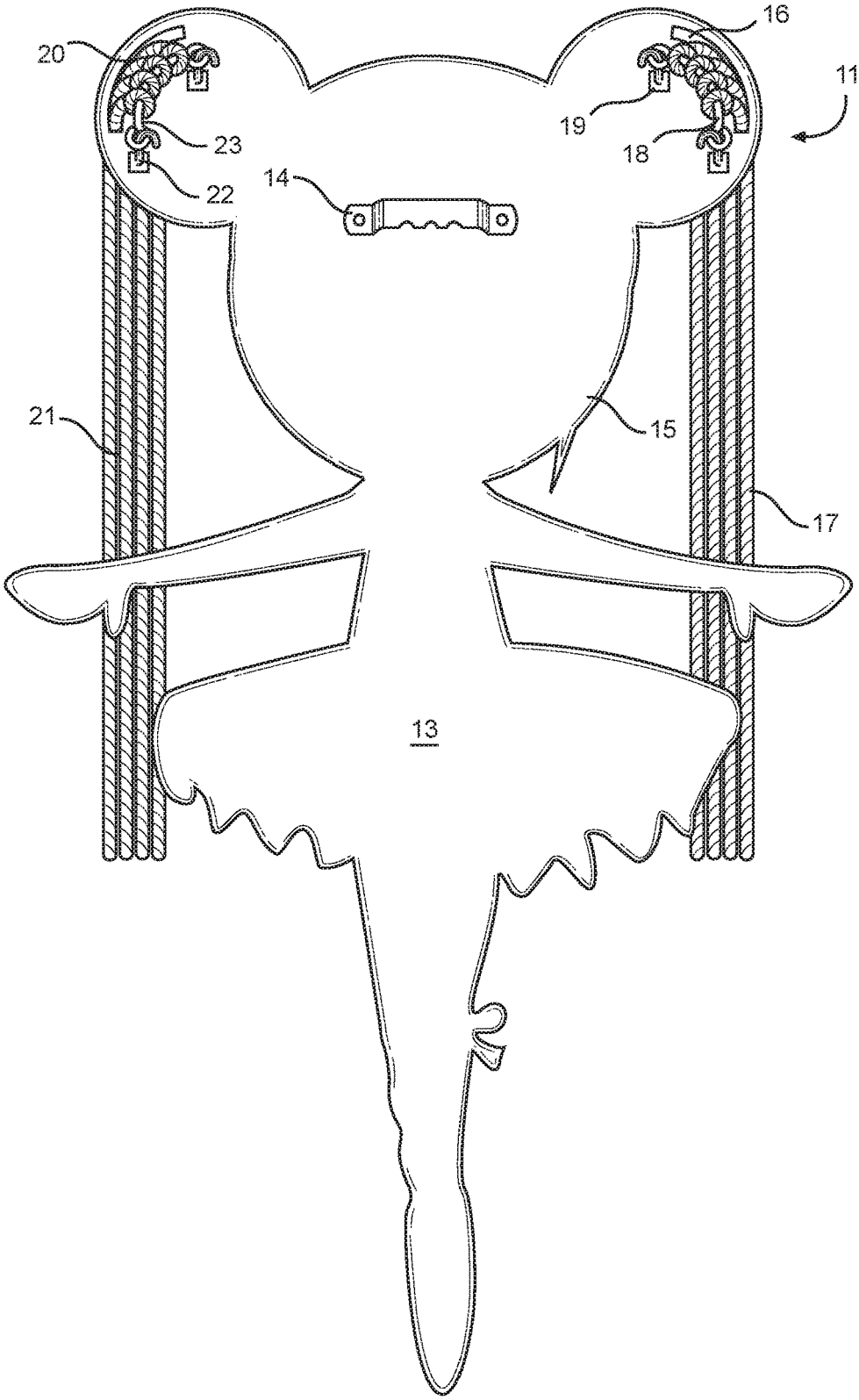
FIG. 3B shows a back facing view of an embodiment of the accessory storage device with an additional aperture and additional rail.

Referring now to FIG. 3A and FIG. 3B, there is shown a front facing view and a back facing view of an embodiment of the accessory storage device with an additional aperture, respectively. In one embodiment of the accessory storage device, a second elongated aperture 20 is disposed elsewhere along the planar member 11. In the illustrated embodiment, the second elongated aperture 20 is disposed such that it mirrors the placement of the first elongated aperture 16 across a vertical axis. In the shown embodiment, a second plurality of elongated strands 21 are affixed to a second rail 23. A fastener 22 is disposed along the rear side 13 of the planar member 11 proximal to the second elongated aperture 20, such as within three inches of the second elongated aperture 20. The fastener 22 is configured to removably receive the second rail 23, such that the second plurality of elongated strands 21 are removably interchangeable with another plurality of elongated strands. The second plurality of elongated strands 21 is configured to removably couple with a plurality of accessories.

Figure 3C:
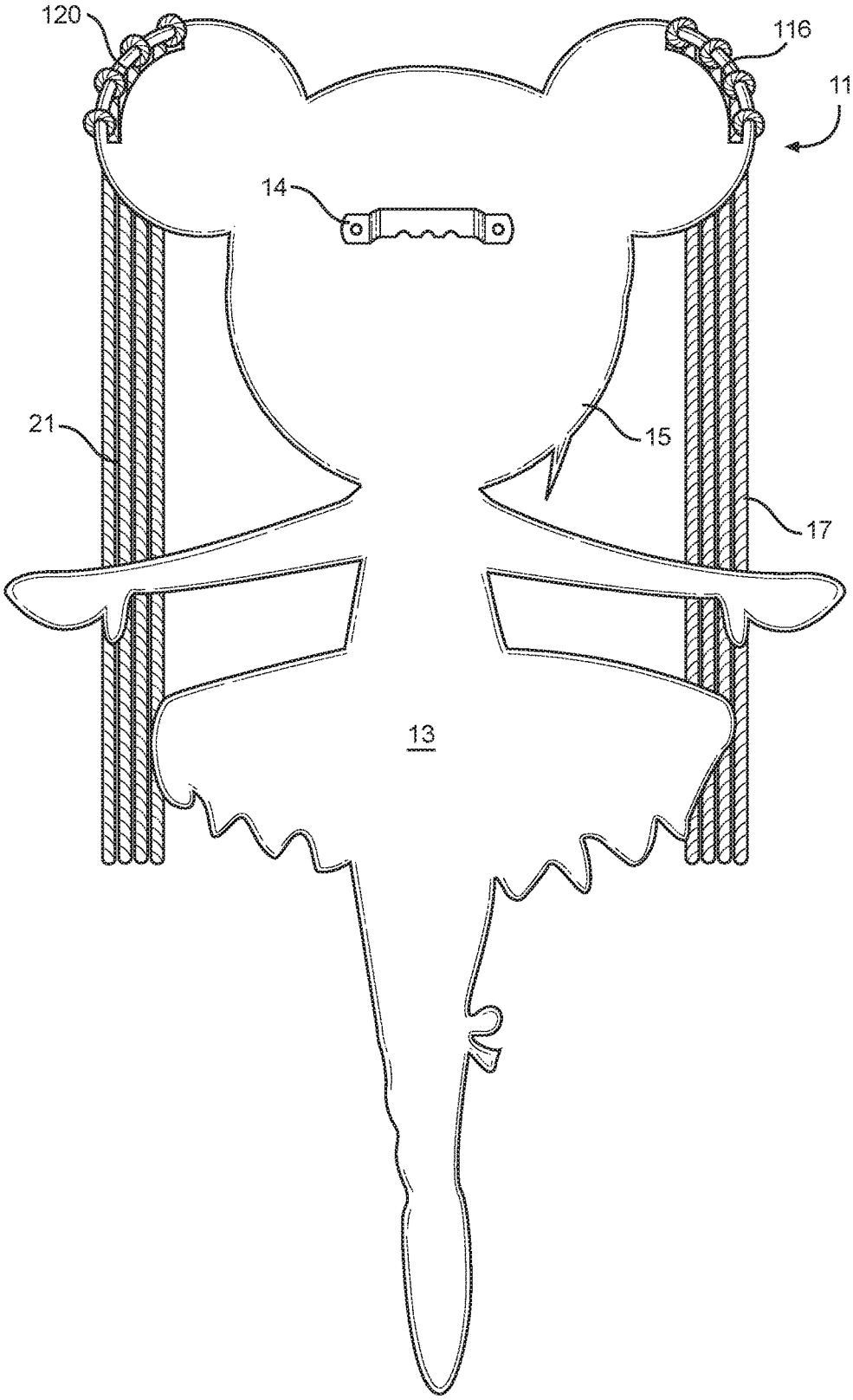
FIG. 3C shows a back facing view of an embodiment of the accessory storage device with an additional aperture and an additional plurality of elongated strands tied to the perimeter of each elongated aperture.

Referring now to FIG. 3C, there is shown a back facing view of an embodiment of the accessory storage device with an additional aperture and an additional plurality of elongated strands tied to the perimeter of each elongated aperture. Similar to FIG. 3A and FIG. 3B, in the shown embodiment there is a second elongated aperture disposed along the planar member 11, wherein the second elongated aperture is disposed such that it mirrors the placement of the first elongated aperture across a vertical axis. In the illustrated embodiment, one plurality of elongated strands 17 is inserted through the first elongated aperture and each strand 17 is individually affixed to the outer perimeter 116 of the first elongated aperture. The additional plurality of elongated strands 21 is inserted through the second elongated aperture and each strand 21 is individually affixed to the outer perimeter 120 of the second elongated aperture. In this way, both pluralities of elongated strands 17, 21 are removably secured to the planar member 11. In one embodiment, each plurality of elongated strands 17, 21 are tied to the outer perimeters 116, 120, respectively, such as through a Lark's head knot. However, in other embodiments, each strand of the pluralities of elongated strands 17, 21 are secured to the outer perimeters 116, 120, respectively, through adhesive.

Figure 4:
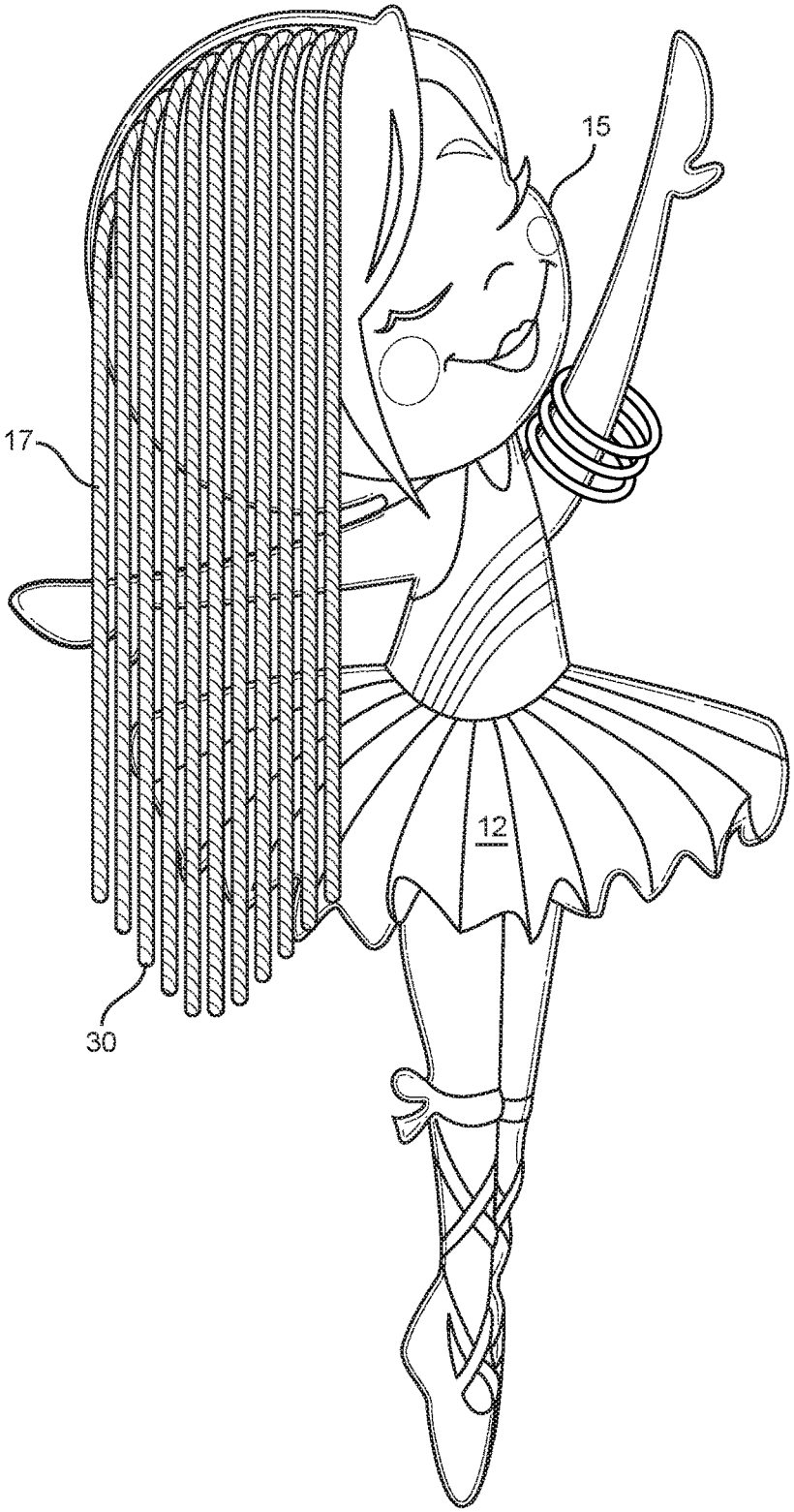
FIG. 4 shows an additional front facing view of an embodiment of the accessory storage device in use.

Referring now to FIG. 4, there is shown an additional front facing view of an embodiment of the accessory storage device in use. In one embodiment, the plurality of elongated strands 17 are configured at a plurality of different lengths, such that the elongated strands together form an arc 30. In the illustrated embodiment, the arc 30 is convexly shaped, however in other embodiments the arc 30 is concavely shaped such that a gradual slope is formed by the plurality of lengths of the plurality of elongated strands 17.

Figure 5A:
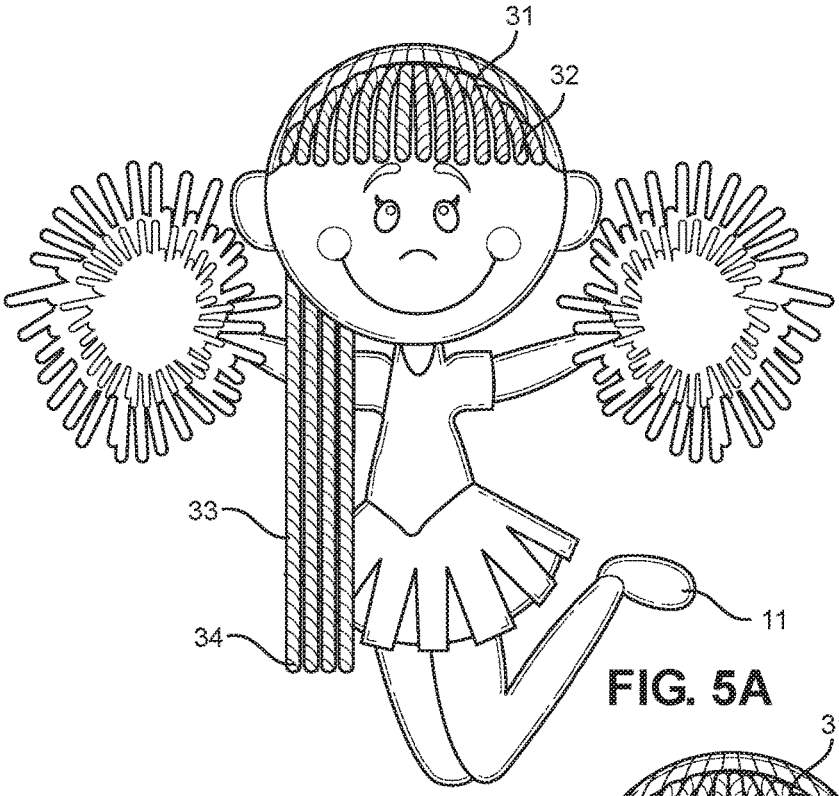
FIG. 5A shows a front facing view of an embodiment of the accessory storage device, wherein the elongated strands are divided into two sections.
Figure 5B:
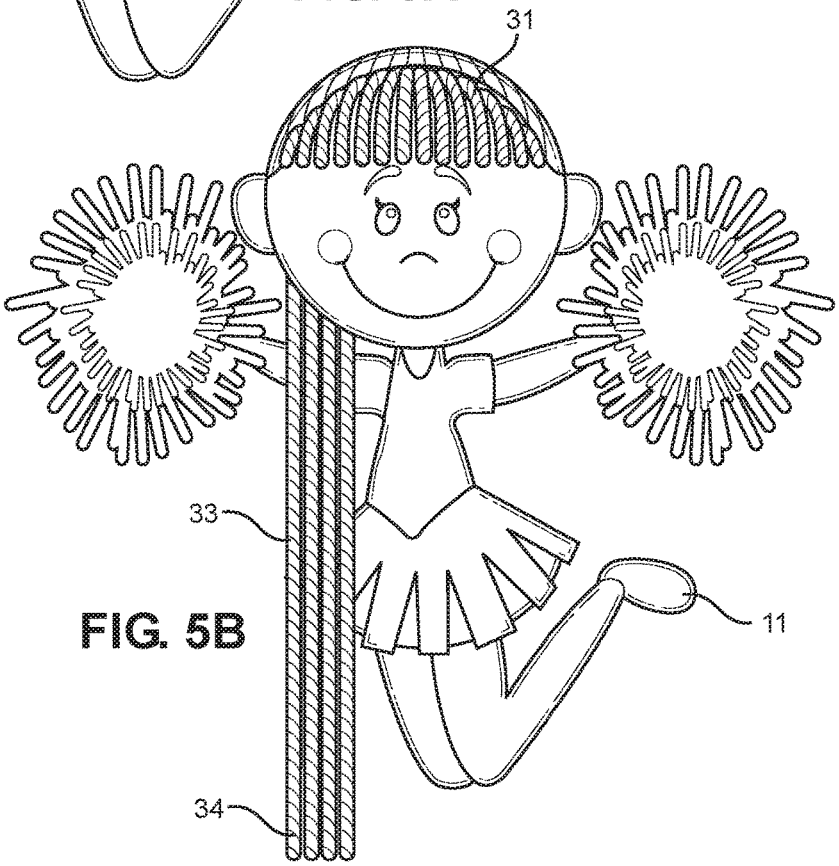
FIG. 5B shows a front facing view of an embodiment of the accessory storage device, wherein the elongated strands are divided into two sections and one section is longer than the planar member.

Referring now to FIGS. 5A and 5B, there are shown front facing views of an embodiment of the accessory storage device, wherein the elongated strands are divided into two sections, and wherein one section is longer than the figure, respectively. In one embodiment, the plurality of elongated strands 17 comprises two sections of different lengths, wherein a first portion of the plurality of elongated strands 31 each comprise a first length 32, and a second portion of the plurality of elongated strands 33 each comprise a second length 34, such that the first length 32 is unequal to the second length 34. In an additional embodiment, the second portion 33 comprises a second length 34 that is greater than the length of the planar member 11.

Figure 5C:
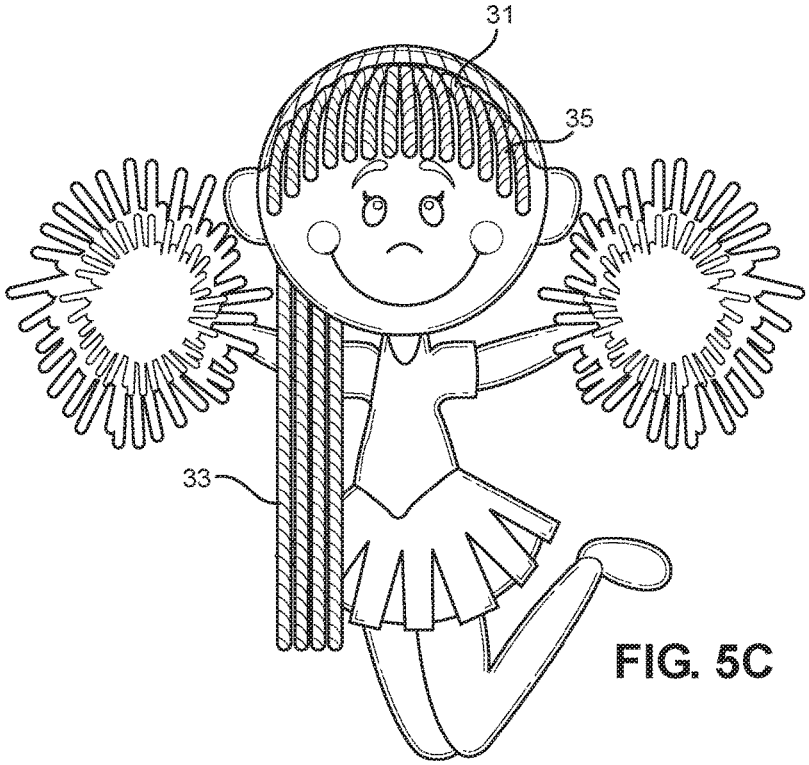
FIG. 5C shows a front facing view of an embodiment of the accessory storage device, wherein the elongated strands are divided into two sections, wherein the length of the first section forms an arc.
Figure 5D:
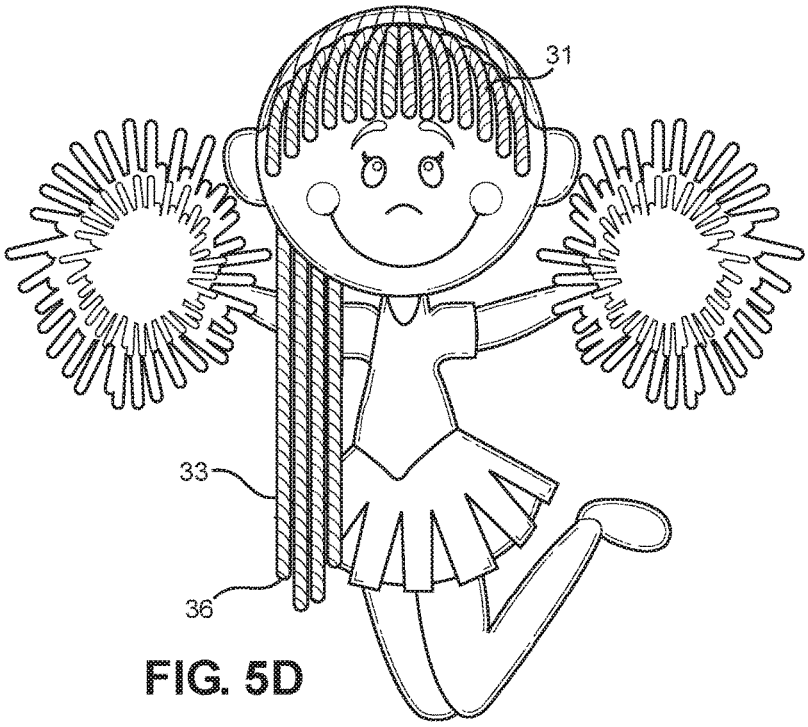
FIG. 5D shows a front facing view of an embodiment of the accessory storage device, wherein the elongated strands are divided into two sections, wherein the length of the second section forms an arc.

Referring now to FIG. 5C and FIG. 5D, there are shown front facing views of an embodiment of the accessory storage device, wherein the elongated strands are divided into two sections, wherein the length of the first section forms an arc and where the length of the second section forms an arc, respectively. In one embodiment, the first portion of the plurality of elongated strands 31 comprises a plurality of different lengths such that an arc 35 is formed. In the illustrated embodiment, the arc 35 is concavely formed, however in other embodiments, the angle of the arc 35 can differ such that a gradual slope is formed. In an additional embodiment, the second portion of the plurality of elongated strands 33 comprises a plurality of different lengths such that an arc 36 is formed. In the illustrated embodiment, the arc 36 is convexly formed, although in subsequent embodiments, the angle of the arc 36 can vary such that a gradual slope is formed.

In operation, an individual, such as a parent, will have the planar member configured to resemble a humanoid or anthropomorphized animal figure with a portion shaped like a head. The individual then inserts each strand of a plurality of elongated strands through the elongated aperture disposed along a peripheral section of the head portion. Each strand of the plurality of elongated strands is tied to the outer perimeter of the elongated aperture, such that it is securely affixed to the planar member. The plurality of elongated strands extends over the front side of the planar member, such that the plurality of elongated strands resemble hair. The individual then utilizes the rear fastener, illustrated as a hook, to removably affix the planar member to a surface, such as a wall. In this way, a user, such as a child, can removably affix a plurality of accessories, such as barrettes, to the plurality of strands on the planar member, and thereby organize their hair accessories while also decorating the planar member, thus encouraging the child to clean and organize their hair accessories.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An accessory storage device, comprising:

a planar member, having a front side and a rear side, wherein the rear side has one or more fasteners affixed thereto;

at least one arm extending from the planar member;

the at least one arm rigidly extending upward, such as to removably receive one or more bands thereon;

an upper portion of the planar member configured to resemble a head, having a periphery along which an elongated aperture is disposed;

a plurality of elongated strands extending from the elongated aperture;

wherein the plurality of elongated strands is configured to affix to a perimeter of the elongated aperture, such that the plurality of elongated strands extends over the front side.

2. The accessory storage device of claim 1, wherein each strand of the plurality of elongated strands is adapted to removably couple with an accessory.

3. The accessory storage device of claim 1, wherein:

the elongated aperture comprises a first elongated aperture and a second elongated aperture;

the pair of elongated apertures disposed such that the second elongated aperture mirrors the placement of the first elongated aperture across a vertical axis of the planar member;

an additional plurality of elongated strands extending from the second elongated aperture;

wherein each elongated aperture is configured to receive a plurality of elongated strands therethrough and thereby affix to the perimeter of the elongated aperture.

4. The accessory storage device of claim 1, wherein the planar member measures at least 12 inches in length along a single axis.

5. The accessory storage device of claim 1, wherein the upper portion of the planar member configured to resemble a head measures at least 6 inches in diameter.

6. The accessory storage device of claim 1, wherein the length of the elongated aperture is at least 25% of the periphery of the upper portion configured to resemble a head.

7. The accessory storage device of claim 1, wherein each elongated strand measures at least 6 inches in length.

8. The accessory storage device of claim 1, wherein the plurality of elongated strands is configured at a plurality of different lengths, such that an end of the elongated strands forms an arc.

9. The accessory storage device of claim 1, wherein a first portion of the plurality of elongated strands each comprise a first length, and a second portion of the plurality of elongated strands each comprise a second length.

10. The accessory storage device of claim 9, wherein the second portion of the plurality of elongated strands each comprise a second length greater than the length of the planar member.

11. The accessory storage device of claim 9, wherein the first portion of the plurality of elongated strands comprise a plurality of different lengths, such that an end of the first portion of elongated strands forms an arc.

12. The accessory storage device of claim 9, wherein the second portion of the plurality of elongated strands comprise a plurality of different lengths, such that an end of the second portion of elongated strands forms an arc.

13. The accessory storage device of claim 1, wherein the elongated strands are affixed to the perimeter of the elongated aperture via adhesive.

14. An accessory storage device, comprising:

a planar member, having a front side and a rear side, wherein the rear side has one or more fasteners affixed thereto;

an upper portion of the planar member configured to resemble a head, having a periphery along which an elongated aperture is disposed;

a plurality of elongated strands affixed to a rail;

wherein the elongated aperture is configured to receive the plurality of elongated strands affixed to the rail therethrough; and the rail removably fastenable to the rear side of the planar member at least one arm extending from the planar member;

the at least one arm being rigid, such that at least one band is securable thereon.

15. The accessory storage device of claim 14, wherein:

the elongated aperture comprises a first elongated aperture and a second elongated aperture;

the pair of elongated apertures are disposed such that the second elongated aperture mirrors the placement of the first elongated aperture across a vertical axis of the planar member;

an additional plurality of elongated strands affixed to an additional rail;

wherein each elongated aperture is configured to receive the plurality of elongated strands affixed to the rail and the additional plurality of elongated strands affixed to the additional rail therethrough; and the rail and the additional rail removably fastenable to the rear side of the planar member.

16. The accessory storage device of claim 14, wherein the rail removably affixes to one or more fasteners disposed at either end of the elongated aperture.

* * * * *